United States Patent [19]

Kii

[11] 4,256,940

[45] Mar. 17, 1981

[54] GAS-BLAST TYPE CIRCUIT INTERRUPTER

[75] Inventor: Masami Kii, Amagasaki, Japan

[73] Assignee: Mitsubishi Denki Kabushiki Kaisha, Tokyo, Japan

[21] Appl. No.: 889,519

[22] Filed: Mar. 23, 1978

[30] Foreign Application Priority Data

Mar. 24, 1977 [JP] Japan ..... 52-32941

[51] Int. Cl.[3] ..... H01H 33/74

[52] U.S. Cl. ..... 200/148 R; 200/148 B; 200/149 B

[58] Field of Search ..... 200/148 R, 148 A, 148 B, 200/148 C, 148 D, 148 E, 148 F, 148 G, 148 H, 148 J, 148 BV, 147 R, 147 A, 147 B, 149 B; 339/111

[56] References Cited

U.S. PATENT DOCUMENTS

| | | | |
|---|---|---|---|
| 3,895,201 | 7/1975 | Schramm et al. | 200/148 R |
| 4,032,736 | 6/1977 | Ruffieux et al. | 200/147 R |
| 4,146,763 | 3/1979 | Handke | 200/148 A |

OTHER PUBLICATIONS

Japanese Laid-Open Utility Model Application No. 47-2934, Laid Open on Dec. 4, 1972.

Japanese Laid-Open Application No. 49-42465, Laid Open on Apr. 13, 1974.

*Primary Examiner*—Gene Z. Rubinson

*Assistant Examiner*—Morris Ginsburg

*Attorney, Agent, or Firm*—Robert E. Burns; Emmanuel J. Lobato; Bruce L. Adams

[57] ABSTRACT

A circuit interrupter comprising a pressure chamber, disposed in fluid communication with an arc extinguishing chamber containing an arc extinguishing fluid, for temporarily storing the arc extinguishing fluid pressure-raised by the arc energy, the high pressure arc extinguishing fluid being puffed at an electric arc established between the separated contacts to extinguish it. The circuit interrupter further comprises means, for relaxing the electric field, disposed on one of the contacts and around an arcing region. The circuit interrupter is prevented from re-arcing due to the transient recovery-voltage after the arc current reaches the zero point, thereby ensuring a complete arc extinction in a short period of time.

5 Claims, 4 Drawing Figures

GAS-BLAST TYPE CIRCUIT INTERRUPTER

BACKGROUND OF THE INVENTION

1. Field of the Invention

This invention relates to circuit interrupters wherein the arc extinction is effected by utilizng an arc extinguishing fluid such as sulfur hexafluoride ($SF_6$) gas, and in particular to circuit interrupters capable of arc extinction by an arc extinguishing fluid increased in pressure by utilizing the energy of the arc itself, wherein the withstand voltage characteristics across the separated contacts is improved to increase the arc extinguishing capability.

2. Description of the Prior Art

A typical a.c. circuit interrupter is operated by mechanically operating a pair of separable contacts at a required interrupting speed to cause the contacts to carry out a separation operation, thereby expanding an electric arc established between the separated contacts and providing a minimum interruption distance therebetween to extinguish the arc. The interruption is completed when the dielectric strength between the separated contacts is restored to a value withstanding the transient recovery-voltage within a short period of time after the extinction of the arc. However, since ionized particles stay between the separated contacts even after the extinction of the arc to degrade the voltage withstand characteristics between the contacts, it is difficult to rapidly restore the insulation characteristics between the contacts. Therefore, in order to improve the voltage withstanding characteristics between the contacts, typical circuit interrupters employ a means for flowing an arc extinguishing fluid such as $SF_6$ gas at a great speed to promote neutralization, diffusion and exhaustion of the ionized particles.

In the conventional circuit interrupters utilizing an arc extinguishing fluid, particularly in the high-performance or heavy-duty interrupters for use under severe circuit conditions wherein the arcing time is short or the transient recovery-voltage is high, the pressure difference in the arc extinguishing fluid and the flow rate of the fluid are increased in an attempt to obtain a more effective diffusing capability. However, with such a conventional measure, a high pressure generating mechanism and associated maintenance and control apparatus are required and the structure must be made high-pressure proof, rendering the over all structure complicated, uneconomical and large-sized.

SUMMARY OF THE INVENTION

Accordingly, the chief object of the present invention is to provide a circuit interrupter eliminating the above described disadvantage of the conventional circuit interrupter, substantially improving voltage withstanding characteristics between the separated contacts and suppressing the re-arcing and re-firing even under high transient recovery-voltage conditions, and simple and compact in structure and advantageous from the economical view point.

With the above object in view, the present invention resides in a circuit interrupter comprising an arc extinguishing chamber containing an arc extinguishing fluid such as $SF_6$ gas and having disposed therein a pair of separable contacts at least one of which is movable, a pressure-raising chamber formed in fluid communication with said arc extinguishing chamber for temporarily storing the arc extinguishing fluid pressure-raised by an electric arc established between the separated contacts, and electric field relaxation means, electrically connected to one of said pair of the contacts to extend toward the other of the contacts to encircle an arcing region between said pair of contacts, thereby to extinguish the arc by said high pressure arc extinguishing fluid stored in said pressure chamber. The electric field relaxation means improves the voltage distribution in the vicinity of the movable contact to prevent the re-arcing by withstanding a high transient recovery-voltage even when the ionized arced gas remains between the separated contacts, thereby ensuring complete arc extinction within a short period of time. The electric field relaxation means may be disposed on either the stationary contact side or the movable contact side.

BRIEF DESCRIPTION OF THE DRAWINGS

The present invention will become more readily apparent from the following description of the preferred embodiments of the invention taken in conjunction with the accompanying drawings, in which.

DESCRIPTION OF THE PREFERRED EMBODIMENTS

Figure 1:
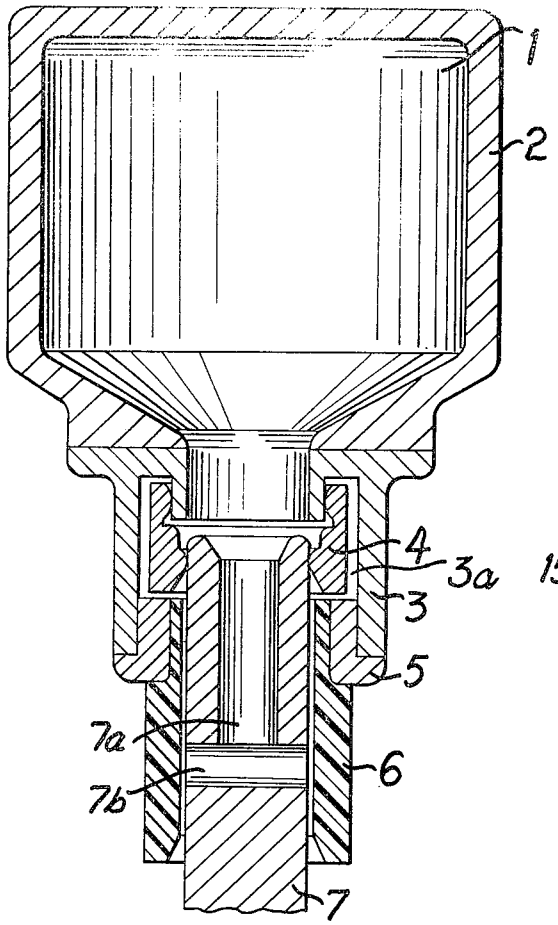
FIG. 1 is a schematic sectional view illustrating a circuit interrupter embodying the present invention.

Referring now to the drawings, and in particular to FIG. 1 thereof, a pressure chamber 1 is defined by a housing 2 formed of an electrically conductive material within a casing containing an arc extinguishing fluid such as $SF_6$ gas. The pressure chamber 1 contains therein the arc extinguishing fluid and is capable of holding temporarily the pressure of the arc extinguishing fluid pressure-raised by the pressure-raising function of an electric arc. An electrically conductive hollow casing 3 is secured to the bottom end of the housing 2 and communicated therewith to form therein an arc extinguishing chamber 3*a*. Within the casing 3, a stationary contact 4 is mounted and is electrically connected to the casing 3. An electric field relaxation ring 5, described in more detail below, is secured to the inner lower end surface of the casing 3 so that it encircles an arcing region between the stationary contacts 4 and a movable contact 7. A cylindrical insulating sleeve 6 is secured to the field relaxation ring 5 to extend from the lower end of the stationary contact 4 toward the movable contact side, thereby encircling the arcing region between the contacts. The movable contact 7 having a hollow portion 7*a* and an opening 7*b* is inserted into the interior of the insulating sleeve 6 and is operable by an unillustrated well-known operating mechanism to contact and separate from the stationary contact 4. The hollow portion 7*a* and the opening 7*b* communicate with the pressure chamber 1 and the arc extinguishing chamber 3*a* to allow the high pressure arc extinguishing fluid to be released therethrough after the arc extinguishing fluid within the pressure chamber 1 is pressure-raised by the electric arc established between the separated contacts 4 and 7.

The circuit interrupter constructed as above described is operated as follows. When the unillustrated operating mechanism is operated by a trip command, the movable contact 7 moves downward. After the movable contact 7 covers a predetermined wiping distance to separate from the stationary contact 4, an electric arc is established between the stationary contact 4, and the movable contact 7. The established arc is expanded by the further downward movement of the movable contact 7, thereby increasing the pressure of the arc extinguishing fluid within the pressure chamber 1 by the pressure-raising function of the arc to the value necessary for arc extinction.

Further downward movement of the movable contact 7 causes the diameter of the electric arc to rapidly decrease to cause the unchoking of the hollow portion *7a* by the arc, and at the same time the opening *7b* of the movable contact 7 opens to the interior space of the outer casing to release the high pressure arc extinguishing fluid in the pressure chamber 1 through the arc extinguishing chamber *3a*, the hollow portion *7a* and the opening *7b*, thereby diffusing and cooling the ionized arced fluid within the arcing region to extinguish the electric arc.

The ionized arced fluid between the separated contacts immediately before the arc current is reduced to zero by the above mentioned functions is not completely exhausted from the arcing region immediately after the extinction of the arc even with a powerful puff of the high pressure arc extinguishing fluid from the pressure chamber 1, but remains in a considerable amount between the separated contacts, particularly on the contact surfaces. Therefore, the conventional circuit interrupter is slow in recovering the dielectric strength in the vicinity of the contact surfaces, resulting in possible re-arcing.

With the circuit interrupter constructed in accordance with the present invention however, the electric field relaxation ring 5 made of a suitable electrically conductive material is provided in the vicinity of the movable contact to substantially enclose the arcing region between the separated contacts, and the electric field in the vicinity of the firing spot on the movable contact 7 after the completion of the arc extinction is greatly relaxed. Therefore, even when the arced fluid remains in the arcing region, a high withstanding voltage is provided to withstand a high transient recovery-voltage appearing across the separated contacts, thereby completely extinguishing the electric arc within a short period of time and preventing re-arcing.

Figure 2:
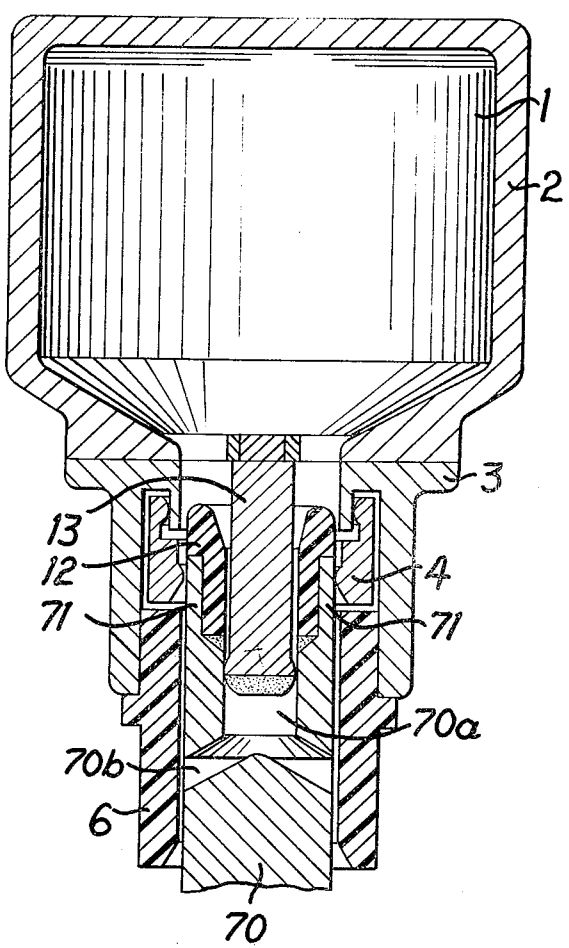
FIG. 2 is a schematic sectional view showing another circuit interrupter embodying the present invention.
Figure 3:
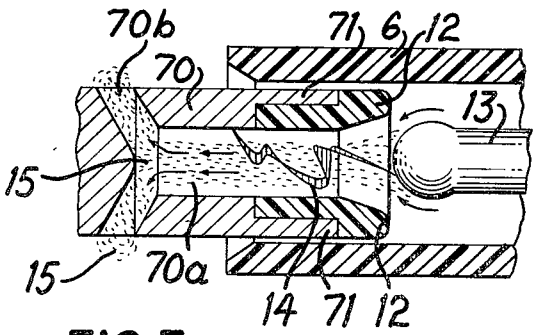
FIGS. 3 and 4 are views useful for understanding the operation of the circuit interrupter shown in FIG. 2.
Figure 4:
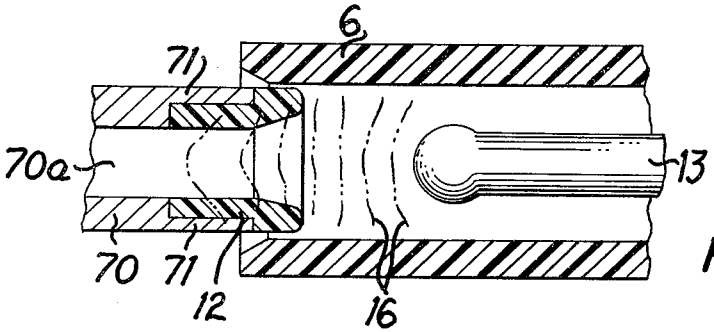

FIGS. 2 to 4 illustrate another circuit interrupter embodying the present invention wherein the electric field relaxation ring is disposed on the movable contact side. In these figures, the same reference numerals as in FIG. 1 designate the same or corresponding components shown in FIG. 1, the description of which components will not be made for the sake of the simplicity of this description.

In FIGS. 2 to 4, a movable contact 70 having a hollow portion 70*a* and an opening 70*b* has formed therein at its top portion a thin portion 71. To the inner surface of the thin portion 71 ring shaped insulating member 12 made of a heat resistant, arc resistant insulating material is secured. Inserted into the insulating member 12 and supported at one end from the connecting portion between the housing 2 and the casing 3 is a second stationary contact 13 which serves as an arcing contact. The inserted end of the second stationary contact 13 extends through the insulating member 12 to establish an electrical contact with the inner surface of the hollow portion 70*a* of the movable contact 70. In this embodiment, the thin portion 71 formed in the tip of the movable contact 70 serves as the electric field relaxation means for relaxing the electric field in the vicinity of the contacts. With the insulating member 12 attached to the movable contact 70, the field strength in the vicinity of the firing points on the movable contact 70 is further decreased.

When the movable contact 70 moves downward as in the case of the circuit interrupter shown in FIG. 1, upon the separation of the movable contact 70 from the first stationary contact 4 and the second stationary contact 13, an electric arc 14 is established between the second stationary contact 13 and the inner surface of the hollow portion 70*a* of the movable contact 70 (FIG. 3). Further downward movement of the movable contact 70 causes the electric arc to extinguish by the high pressure arc extinguishing fluid from the pressure chamber 1 in the same manner as in the case of the interrupter shown in FIG. 1.

In FIG. 4, wherein the electric potential distribution between the separated contacts immediately after the arc has been extinguished is shown by two-dot-and-dash lines designated by the reference numeral 16, it is seen that the electric field distribution in the vicinity of the firing point of the movable contact 70 is improved by the electric field relaxation ring or the thin portion 71 formed in the tip of the movable contact 70.

In the embodiment shown in FIG. 2, in addition to the arc extinguishing effect obtained within a short period of time owing to the electric field relaxation ring, another advantageous effect is obtained in that the ionized arced fluid is directly cooled and expelled as shown by the reference numeral 15 in FIG. 3 since, as seen in FIG. 3, the arc 14 is established on the inner surface of the hollow portion 70*a* of the movable contact 70 and the hollow portion 70*a* serves as a flow path for the ionized arc fluid and the arc extinguishing fluid.

As apparent from the foregoing description, according to the present invention, an electric field relaxation ring for substantially enclosing the arcing region is diposed in the vicinity of the contact surface where the ion concentration is the highest while the arc is being established, where the ions remain even after the arc extinction, and which is critical in determining the interrupting range in relation to the transient recovery-voltage. Therefore, the electric field on the surface of the arcing portion is relaxed within a short period of time after the arc current reaches the zero point, enabling suppression of re-arcing and a reliable arc extinction within a short period of time. Therefore, an improved circuit interrupter increased in effective arc extinguishing performance, of small-sized, and economical has been provided.

What is claimed is:

1. A gas-blast type circuit interrupter, comprising:

an arc extinguishing chamber containing in use an arc extinguishing fluid and having disposed therein a pair of separable contacts at least one of which is movable;

a pressure chamber in fluid communication with said arc extinguishing chamber for temporarily storing the arc extinguishing fluid at a raised pressure raised by an electric arc established in use between said contacts when the same are separated;

and electric field relaxation means for relaxing an electric field in the vicinity of said contacts, thereby improving the voltage withstanding characteristics across the separated contacts; said electric field relaxation means consisting essentially of an electrically conductive annular member electrically connected to one of said pair of contacts and extending toward the other of said pair of contacts and circumscribing the electric arc which is established in use between said pair of contacts, and an electrically insulative heat resistant arc resistant material covering surface portions of said annular member facing the electric arc which is established in use, and said annular member having dimensions effective to relax an electric field in the region of arcing between said pair of contacts after arc extinction is completed.

2. A circuit interrupter as claimed in claim 1, wherein said pair of contacts comprises a stationary contact and a movable contact, and said electric field relaxation means is disposed on said movable contact.

3. A circuit interrrupter as claimed in claim 1, wherein said pair of contacts comprises a stationary contact and a movable contact, and said electric field relaxation means is disposed on said stationary contact.

4. A circuit interrupter as claimed in claim 2, wherein said annular member is an annular thin wall tip portion of said movable contact.

5. A gas-blast type circuit interrupter, comprising:

an arc extinguishing chamber containing in use an arc extinguishing fluid and having disposed therein a pair of separable contacts at least one of which is movable;

a pressure chamber in fluid communication with said arc extinguishing chamber for temporarily storing the arc extinguishing fluid at a raised pressure raised by an electric arc established in use between said contacts when the same are separated;

and electric field relaxation means, electrically connected to one of said pair of contacts and extending toward the other of said pair of contacts, for relaxing an electric field in the vicinity of said contacts, thereby improving the voltage withstanding characteristics across the separated contacts;

wherein said pair of contacts comprises a stationary contact and a movable contact, and said electric field relaxation means is disposed on said movable contact, and wherein said stationary contact comprises a first and a second contact portion; and said movable contact comprises a hollow member the outer peripheral surface of which is capable of slidably engaging said first contact portion for establishing electrical contact therewith, and the inner surface of which is capable of electrically connecting with said second contact portion; said electric field relaxation means including a relatively thin annular wall portion extending integrally from the tip of said movable contact toward said stationary contact, said thin wall portion having fixed along the inner surface thereof an insulating annular member made of a heat resistant, arc resistant material.

* * * * *